US006283164B1

(12) United States Patent
Parks

(10) Patent No.: US 6,283,164 B1
(45) Date of Patent: Sep. 4, 2001

(54) WHIP ROLL FOR AIR JET LOOM WEAVING OF RESIN COMPATIBLE YARN

(75) Inventor: Steven J. Parks, Lexington, NC (US)

(73) Assignee: PPG Industries Ohio, Inc., Cleveland, OH (US)

( * ) Notice: Subject to any disclaimer, the term of this patent is extended or adjusted under 35 U.S.C. 154(b) by 0 days.

(21) Appl. No.: 09/639,689

(22) Filed: Aug. 16, 2000

(51) Int. Cl.[7] ..... D03D 49/22
(52) U.S. Cl. ..... 139/114
(58) Field of Search ..... 139/114, 115

(56) References Cited

U.S. PATENT DOCUMENTS

| | | | | |
|---|---|---|---|---|
| 1,705,637 | * | 3/1929 | Deleu | 139/114 |
| 2,966,930 | * | 1/1961 | Pfarrwaller | 139/114 |
| 4,121,625 | * | 10/1978 | Porter et al. | 139/114 |
| 5,305,802 | * | 4/1994 | Fehrenbach | 139/114 |

OTHER PUBLICATIONS

IPC–EG–140 "Specification for Finished Fabric Woven from "E" Glass for Printed Boards", publication from Institute for Interconnecting and Packaging Electronic Circuits, Jun. 1997, p. 1.

The American Cotton Handbook, vol. Two, 3rd Edition, pp. 633–641.

U.S. Serial No. 09/620,526 entitled "Impregnating Glass Fiber Strands and Products Including the Same", filed Jul. 20, 2000, assigned to PPG Industries Ohio, Inc.

* cited by examiner

*Primary Examiner*—Andy Falik
(74) *Attorney, Agent, or Firm*—Andrew C. Siminerio

(57) ABSTRACT

A method of delivering warp yarn into an air jet loom, comprising the steps of: providing a loom beam comprising warp yarn having a resin compatible coating; drawing warp yarn from the loom beam; contacting the warp yarn with a whip roll having a reduced surface area such that the warp yarn contacts at least a portion of the reduced surface area of the whip roll; and directing the warp yarn into an air jet loom. In one non-limiting embodiment of the invention, the reduced surface area of the whip roll is no greater than 50% of its equivalent surface and is textured, the reduced surface area of the whip roll includes a plurality of grooves, the warp yarn is a fine yarn provided at a warp yarn density of at least 50 yarns per inch and forms a warp shed, and a fill yarn having a resin compatible coating is inserted into the warp shed.

19 Claims, 2 Drawing Sheets

WHIP ROLL FOR AIR JET LOOM WEAVING OF RESIN COMPATIBLE YARN

FIELD OF THE INVENTION

The present invention relates to an air jet loom, and in particular to weaving yarns having a resin compatible coating on an air jet loom.

BACKGROUND OF THE INVENTION

Air jets looms are widely used for high speed fabric weaving. Typically, a plurality of warp yarns are wound around a loom beam positioned at one end of the air jet loom. The warp yarns are unwound from the loom beam and extend the length of the loom. A whip roll is positioned to support the sheet of warp yarns as it advances to the weaving position of the loom and ensure that the yarn is delivered to the loom at the same weaving angle as the loom beam diameter changes during weaving. The whip roll also maintains the proper tension in the warp yarn during the weaving operation. One or more weft yarn feed systems deliver, i.e. insert, weft yarn into a shed formed by warp yarns using a main air jet nozzle assisted by groups of relay nozzles disposed across the warp shed, as is well known to those skilled in the art.

Depending in the nature of the warp yarn, problems can occur as the yarn is delivered from the loom beam to the loom. For example, the warp yarn can to move and roll laterally along the whip roll. This, in turn, can result in adjacent warp yarn strands becoming entangled and twisted together as they advance into the loom. If the yarns break as they enter the loom, the weaving operation will stop. To address this problem, grooved whip rolls have been used to stabilize the warp sheet. It has been observed that this rolling and entanglement problem is of particular concern where the weaving operation uses warp yarn having a resin compatible coating. These coatings are typically tacky, which adds to the potential for the yarns to stick together and break as they enter the loom. It has been further observed that fine yarns, e.g. E-225 and D-450 yarns, with resin compatible coatings that are used as warp yarn in a weaving operation exhibit a greater potential to become entangled because of the higher warp yarn density associated with such fabrics.

It would be advantageous to provide a weaving system that ensures continuous, uninterrupted feed of the warp yarn having a resin compatible coating.

SUMMARY OF THE INVENTION

The present invention provides a method of delivering warp yarn into an air jet loom, comprising the steps of: providing a loom beam comprising warp yarn having a resin compatible coating; drawing warp yarn from the loom beam; contacting the warp yarn with a whip roll having a reduced surface area such that the warp yarn contacts at least a portion of the reduced surface area of the whip roll; and directing the warp yarn into an air jet loom. In one non-limiting embodiment of the invention, the reduced surface area of the whip roll is no greater than 50% of its equivalent surface and is textured, the reduced surface area of the whip roll includes a plurality of grooves, the warp yarn is a fine yarn provided at a warp yarn density of at least 50 yarns per inch and forms a warp shed, and a fill yarn having a resin compatible coating is inserted into the warp shed.

The present invention further provides a fabric made according to the above described method.

BRIEF DESCRIPTION OF THE DRAWINGS

FIG, 1 is a schematic isometric view of an air jet loom incorporating features of the present invention.

DETAILED DESCRIPTION OF THE INVENTION

Figure 1:
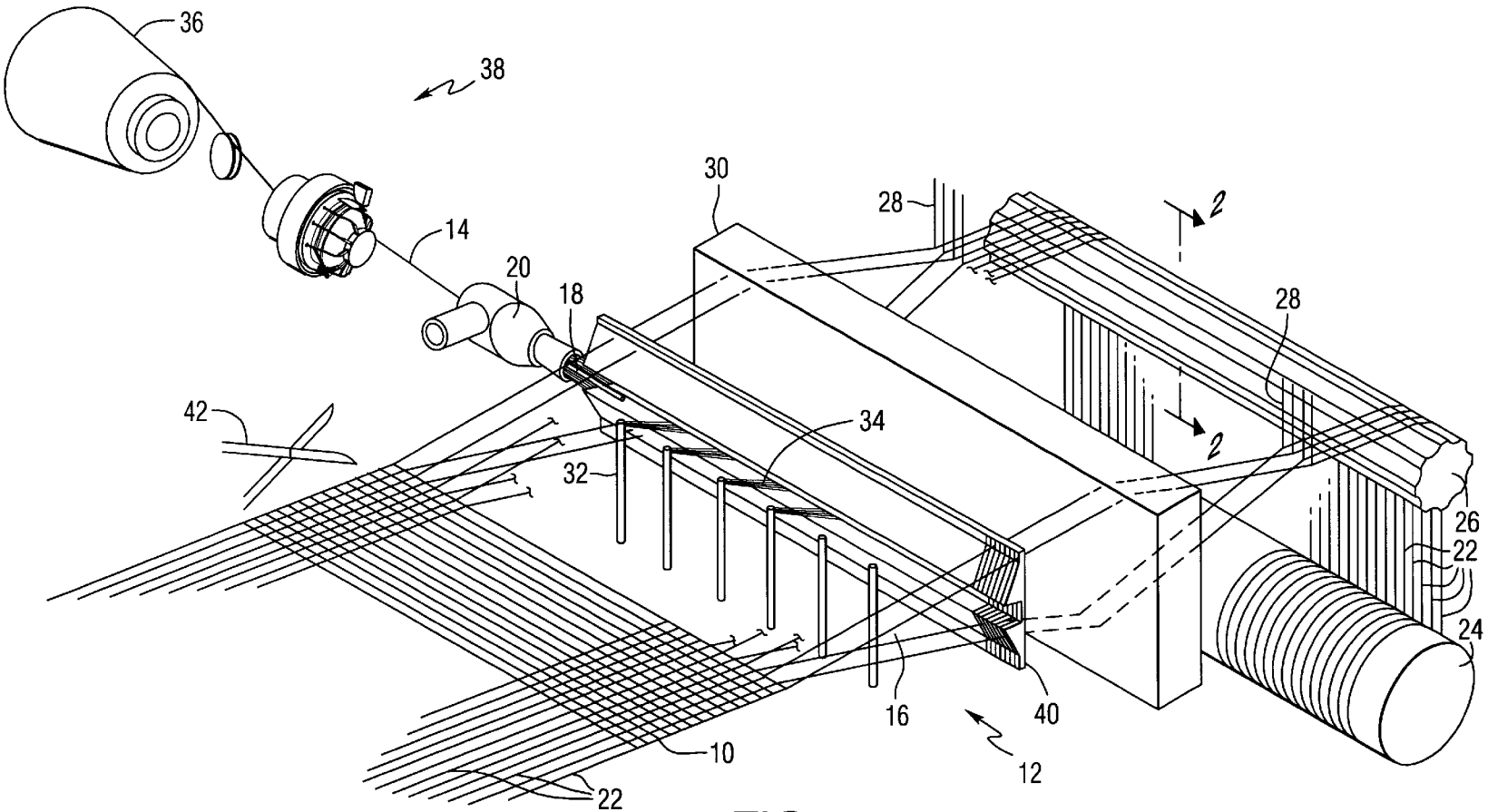

A woven fabric 10 can be formed by using any conventional loom well known to those skilled in the art, such as a shuttle loom or rapier loom, but preferably is formed using an air jet loom as shown in FIG. 1 so as to increase the speed at which the fabric is fabricated. Nonlimiting examples of commercial air jet looms include those available from Tsudakoma of Japan, e.g. Model No.103 and 103I, and Sulzer Brothers Ltd. of Zurich, Switzerland, e.g. Sulzer Ruti Model Nos. L-5000 and L-5200.

A typical air jet loom 12 is shown schematically in FIG. 1 and is well known to those skilled in the art. In operation, fill yarn (weft) 14 is inserted into a warp shed 16 of the loom 12 by a blast of compressed air 18 from one or more main nozzles 20. The warp shed 16 is formed by the warp yarn 22, which is supplied by a loom beam 24, passes around a whip roll 26, and extends longitudinally along the length of the air jet loom 12. The whip roll 26 supports the sheet of warp yarn and maintains the warp yarn at a constant weaving angle, i.e. the angle at which the warp yarn enters the loom 12, as the loom beam decreases in diameter during the weaving operation. In addition, the whip roll 26 maintains the desired tension in the warp yarn 22 during the weaving operation. From the whip roll 26, the warp yarn 22 passes through a bank of individual drop wires 28, which will stop the weaving operation when one of the warp yarns break, and a harness 30, which supports the heddles (not shown). The each warp yarn passes through an eye of a heddle and the heddles alternately raise and lower the warp yarn and hold it in place in accordance with the weave style to form the warp shed 16 as the fill yarn 14 is propelled across the width of the fabric 10 through the warp shed 16, as is well known in the art. Non-limiting examples of typical industrial glass fiber fabric style widths would include 0.96 meter (38 inch), 1.12 meter (44 inch), and 1.27 meter (50 inch).

The air jet loom 12 can have a single or multiple main nozzles 20, but preferably also has a plurality of supplementary, relay nozzles 32 along the warp shed 16 for providing blasts of supplementary air 34 to the fill yarn 14 to maintain the desired air pressure required to propel the yarn 14 across the loom 12. The air pressure supplied by the main air nozzle 20 preferably ranges from about 34 to about 413 kiloPascals (kPa) (about 5 to about 60 pounds per square inch (psi)), and more preferably is about 55 to about 310 kPa (about 8 to about 45 psi), depending on machine type, yarn type, fabric style and width, weaving speed, etc. Although not limiting in the present invention, the air jet loom 12 typically has about 15 to about 18 supplementary air nozzles 32. The air pressure supplied to each supplementary air nozzle 32 preferably ranges from about 300 to about 600 kPa (about 43.5 to about 87 psi).

In operation, a predetermined length of the fill yarn 14 is drawn from the supply package 36 by a feeding system 38 at a feed rate of about 180 to about 550 meters (about 197 to about 601 yards) per minute, and preferably about 274 meters (about 300 yards) per minute. System 38 measures and accumulates the yarn 14 prior to being inserted into the warp shed 16 by main nozzle 20. The fill yarn 14 is then drawn into the main nozzle 20 and a blast of air propels the yarn across the width of the fabric through the warp shed 16 and a tunnel reed 40. When the insertion is completed, the end of the yarn near the main nozzle 18 is cut by a cutter 42.

Figure 2:
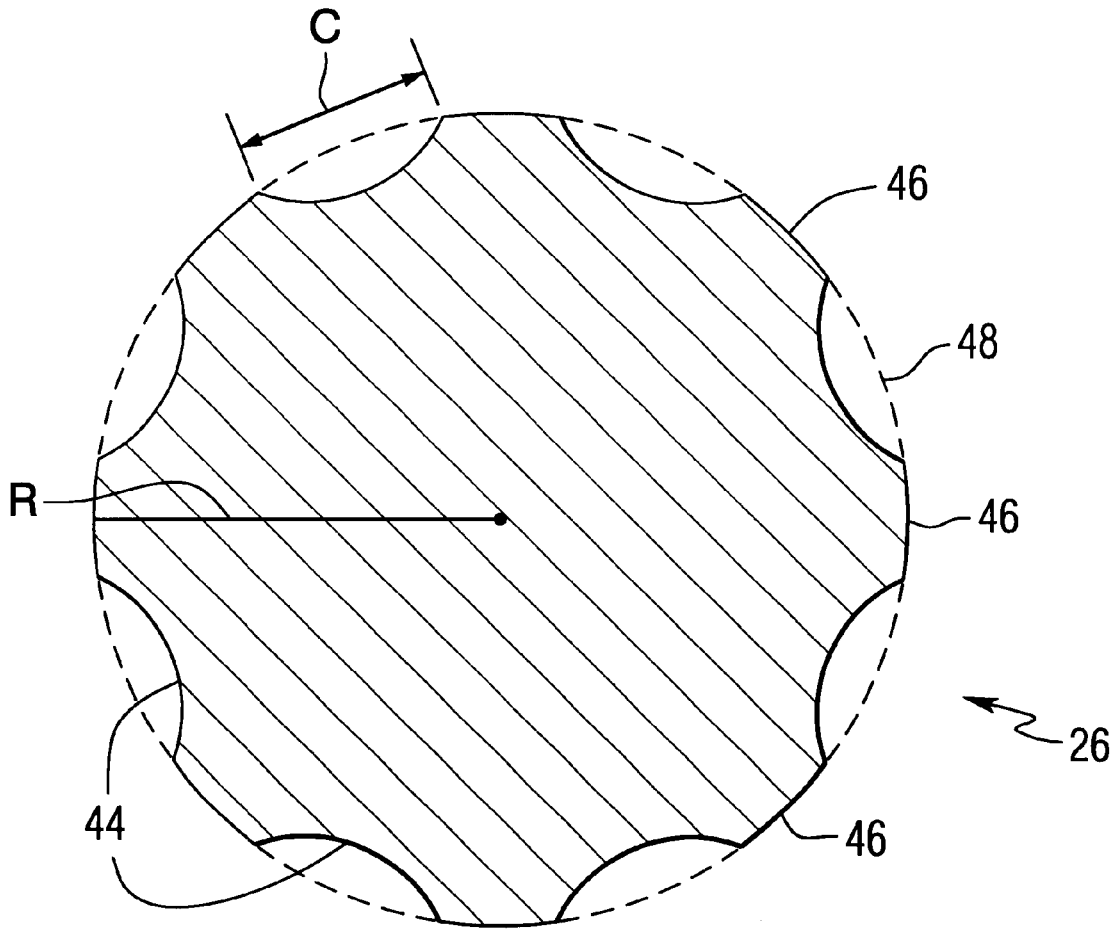
FIG. 2 is an view of a whip roll taken along line 2—2 of FIG. 1.

Referring to FIG. 2, the whip roll 26 is configured to have a reduced roll surface so as to reduce the physical contact between the warp yarn 22 and the surface of the roll 26. In one non-limiting embodiment of the invention, the surface of roll 26 includes a plurality of grooves 44 such that the yarn 22 contacts only surface portions 46 of the roll 26. This type of roll is also referred to as a fluted roll. The grooves 44 can have any configuration that is effective in reducing the surface area of the whip roll 26 which contacts the yarn 22. Although not required, it is preferred that surface portion 46 be no greater than 50% of the equivalent surface 44 of the whip roll 26, and more preferably no greater than about 25% of the equivalent surface 48. As used herein, the term "reduced surface area" means that portion of roll 26 that can physically contact the yarn 22, and the term "equivalent surface" means the total surface of a cylindrically shaped whip roll without any removal of the roll surface. For example and referring to FIG. 2, if a cylindrically shaped whip roll 26, without grooves 44, has a radius R of 3 inches (7.62 cm), the equivalent surface 48 would be 18.8 $inch^2$ per inch of length of the roll (47.9 $cm^2$/cm of length). Furthermore, if the roll 26 included eight similar grooves each having a chord length C along the surface of the roll 26 of 1⅜ inches, the reduced surface area, i.e. surface portion 46, would be about 7.75 $inch^2$ per inch of length of the roll (19.7 $cm^2$/cm of length), or about 41% of the equivalent surface 48.

Although the particular embodiment of the whip roll 26 illustrated in FIGS. 1 and 2 shows the grooves 44 being equally spaced about the circumference of the roll 26 and generally parallel to each other, these details of the roll are not required. More specifically, it is contemplated that the grooves need not be equally spaced apart from nor be parallel to each other. It is further contemplated that in one non-limiting embodiment of the invention, the whip roll includes one or move sets of spiraling grooves, e.g. a first set of grooves spiraling in one direction around whip roll and a second set of grooves spiraling in a direction opposite that of the first set of grooves.

Although not required, it is preferred that the surface portion 46 of whip roll 26 be treated or coated with a material that provides a textured surface, e.g. a roughened or matte finish. It is believed that this textured surface reduces the friction between the warp yarn 22 and surface portion 46 of the whip roll 26 as compared to a smooth surface because there is less physical contact between a surface portion 46 and the yarn 22, so that the yarn 22 can slide along the surface portion 46. This reduction in contact at a surface portion 46 in combination with reduced total surface of the whip roll 26, reduces the potential of the yarn 22 to roll and move along the whip roll surface and become entangled with adjacent yarn strands 22. Although not limiting in the present invention, surface portions 46 can be treated by sandblasting, etching or applying a coating to provide the desired textured surface. In another non-limiting embodiment of the invention, the whip roll 26 is made of metal, e.g. aluminum, and surface portions 46 are provided with a roughened, or matte, finish.

As discussed earlier, the present invention is particularly applicable for yarns comprising glass fibers coated with a coating that is compatible with a resin matrix material into which the yarn is incorporated. As used herein, the terms "compatible with a resin matrix material" or "resin compatible" mean the coating composition applied to the glass fibers is compatible with the resin matrix material into which the glass fibers will be incorporated such that the coating composition (or selected coating components) achieves at least one of the following properties: does not require removal prior to incorporation into the matrix material (such as by de-greasing or de-oiling), facilitates good penetration of the matrix material through the individual bundles of fibers in a mat or fabric incorporating the yarn and good penetration of the matrix material through the mat or fabric during conventional processing and results in final composite products having desired physical properties and hydrolytic stability.

Without limiting the present invention, one embodiment of the resin compatible coating composition on the glass fibers comprises one or more, and preferably a plurality of particles that when applied to the fibers adhere to the fibers and provide one or more interstitial spaces between adjacent glass fibers. Nonlimiting examples of preferred particles include hexagonal boron nitride and hollow styrene acrylic polymeric particles.

In addition to the particles, a nonlimiting embodiment of the resin compatible coating composition preferably comprises one or more film-forming materials, such as organic, inorganic and polymeric materials. Nonlimiting examples of film-forming materials include vinyl polymer, such as, but are not limited to, polyvinyl pyrrolidones, polyesters, polyamides, polyurethanes, and combinations thereof.

In addition to or in lieu of the film forming materials discussed above, a nonlimiting embodiment of the resin compatible coating compositions can include one or more glass fiber coupling agents such as organo-silane coupling agents, transition metal coupling agents, phosphonate coupling agents, aluminum coupling agents, amino-containing Werner coupling agents and mixtures thereof.

A nonlimiting embodiment of the resin compatible coating compositions can further comprise one or more softening agents or surfactants. Nonlimiting examples of softening agents include amine salts of fatty acids, alkyl imidazoline derivatives, acid solubilized fatty acid amides, condensates of a fatty acid and polyethylene imine and amide substituted polyethylene imines.

A nonlimiting embodiment of the resin compatible coating compositions can further include one or more lubricious materials that are chemically different from the polymeric materials and softening agents discussed above to impart desirable processing characteristics to the fiber strands during weaving. Nonlimiting examples of such fatty acid esters useful in the present invention include cetyl palmitate, cetyl myristate, cetyl laurate, octadecyl laurate, octadecyl myristate, octadecyl palmitate and octadecyl stearate. The lubricious materials can also include non-polar petroleum waxes and water-soluble polymeric materials, such as but not limited to polyalkylene polyols and polyoxyalkylene polyols.

A nonlimiting embodiment of the resin compatible coating compositions can additionally include one or more emulsifying agents for emulsifying or dispersing components of the coating compositions, such as the particles and/or lubricious materials. Nonlimiting examples of suitable emulsifying agents or surfactants include polyoxyalkylene block copolymers, ethoxylated alkyl phenols, polyoxyethylene octylphenyl glycol ethers, ethylene oxide derivatives of sorbitol esters, polyoxyethylated vegetable oils, ethoxylated alkylphenols, and nonylphenol surfactants.

Other additives can be included in a nonlimiting embodiment of the resin compatible coating compositions, such as crosslinking materials, plasticizers, silicones, fungicides, bactericides and anti-foaming materials. Organic and/or inorganic acids or bases in an amount sufficient to provide the coating composition with a pH of 2 to 10 can also be included in the resin compatible coating composition.

Nonlimiting examples of resin compatible coatings are shown in Table 1.

TABLE 1

WEIGHT PERCENT OF COMPONENT ON TOTAL SOLIDS BASIS

| COMPONENT | Examples A | B | C | D | E | F |
|---|---|---|---|---|---|---|
| PVP K-30[1] | 13.7 | 13.4 | 13.5 | 13.4 | | |
| STEPANTEX 653[2] | 27.9 | 27.3 | | | | |
| A-187[3] | 1.7 | 1.6 | 1.9 | 1.9 | 2.8 | 2.3 |
| A-174[4] | 3.4 | 3.3 | 3.8 | 3.8 | 4.8 | 4.8 |
| EMERY 6717[5] | 2.3 | 2.2 | 1.9 | 1.9 | | |
| MACOL OP-10[6] | 1.5 | 1.5 | | | | |
| TMAZ-81[7] | 3.0 | 3.0 | | | | |
| MAZU DF-136[8] | 0.2 | 0.2 | | | | |
| ROPAQUE OP-96[9] | 39.3 | 38.6 | | | | |
| RELEASECOAT-CONC 25[10] | 4.2 | 6.3 | 6.4 | 3.8 | | |
| POLARTHERM PT 160[11] | 2.7 | 2.6 | 2.6 | 5.9 | | |
| SAG 10[12] | | | 0.2 | 0.2 | | |
| RD-847A[13] | | | 23.2 | 23.0 | | |
| DESMOPHEN 2000[14] | | | 31.2 | 31.0 | 44.4 | 44.1 |
| PLURONIC F-108[15] | | | 8.5 | 8.4 | | 10.9 |
| ALKAMULS EL-719[16] | | | 3.4 | 2.5 | | |
| ICONOL NP-6[17] | | | 3.4 | 4.2 | | 3.6 |
| POLYOX WSR 301[18] | | | | | 0.6 | 0.6 |
| DYNAKOLL Si 100[19] | | | | | 29.1 | 28.9 |
| SERMUL EN 668[20] | | | | | 2.9 | |
| SYNPERONIC F-108[21] | | | | | 10.9 | |
| EUREDUR 140[22] | | | | | 4.9 | |
| VERSAMID 140[23] | | | | | | 4.8 |

[1]PVP K-30 polyvinyl pyrrolidone which is commercially available from ISP Chemicals of Wayne, New Jersey.
[2]STEPANTEX 653 which is commercially available from Stepan Company of Maywood, New Jersey.
[3]A-187 gamma-glycidoxypropyltrimethoxysilane which is commercially available from CK Witco Corporation of Tarrytown, New York.
[4]A-174 gamma-methacryloxypropyltrimethoxysilane which is commercially available from CK Witco Corporation of Tarrytown, New York.
[5]EMERY ®6717 partially amidated polyethylene imine which is commercially available from Cognis Corporation of Cincinnati, Ohio.
[6]MACOL OP-10 ethoxylated alkylphenol; this material is similar to MACOL OP-10 SP except that OP-10 SP receives a post treatment to remove the catalyst; MACOL OP-10 is no longer commercially available.
[7]TMAZ-81 ethylene oxide derivative of a sorbitol ester which is commercially available from BASF Corp. of Parsippany, New Jersey.
[8]MAZU DF-136 antifoaming agent which is commercially available from BASF Corp. of Parsippany, New Jersey.
[9]ROPAQUE ®OP-96, 0.55 micron particle dispersion which is commercially available from Rohm and Haas Company of Philadelphia, Pennsylvania.
[10]ORPAC BORON NITRIDE RELEASECOAT-CONC 25 boron nitride which is commercially available from ZYP Coatings, Inc. of Oak Ridge, Tennessee.
[11]POLARTHERM ®PT 160 boron nitride powder which is commercially available from Advanced Ceramics Corporation of Lakewood, Ohio.
[12]SAG 10 antiforming material, which is commercially available from CK Witco Corporation of Greenwich, Connecticut.
[13]RD-847A polyester resin which is commercially available from Borden Chemicals of Columbus, Ohio.
[14]DESMOPHEN 2000 polyethylene adipate diol which is commercially available from Bayer Corp. of Pittsburgh, Pennsylvania.
[15]PLURONIC ™F-108 polyoxypropylene-polyoxyethylene copolymer which is commercially available from BASF Corporation of Parsippany, New Jersey.
[16]ALKAMULS EL-719 polyoxyethylated vegetable oil which is commercially available from Rhone-Poulenc.
[17]ICONOL NP-6 alkoxylated nonyl phenol which is commercially available from BASF Corporation of Parsippany, New Jersey.
[18]POLYOX WSR 301 poly(ethylene oxide) which is commercially available from Union Carbide Corp. of Danbury, Connecticut.
[19]DYNAKOLL Si 100 rosin which is commercially available from Eka Chemicals AB, Sweden.

TABLE 1-continued

WEIGHT PERCENT OF COMPONENT ON TOTAL SOLIDS BASIS

| COMPONENT | Examples A | B | C | D | E | F |
|---|---|---|---|---|---|---|

[20]SERMUL EN 668 ethoxylated nonylphenol which is commercially available from CON BEA, Benelux.
[21]SYNPERONIC F-108 polyoxypropylene-polyoxyethylene copolymer; it is the European counterpart to PLURONIC F-108.
[22]EUREDUR 140 is a polyamide resin, which is commercially available from Ciba Geigy, Belgium.
[23]VERSAMID 140 polyamide resin which is commercially available from Cognis Corp. of Cincinnati, Ohio.

Additional nonlimiting examples of glass fiber yarns having a resin compatible coating are disclosed in U.S. Ser. No. 09/620,526 entitled "Impregnating Glass Fiber Strands and Products Including the Same" and filed Jul. 20, 2000, which is hereby incorporated by reference.

Although the whip roll as disclosed herein is particularly useful when weaving glass fiber yarns having a resin compatible coating, the whip roll is especially effective when weaving fine yarns having a resin compatible coating. As used herein, the term "fine yarn" means yarns having a filament diameter of no greater than about $2.9\times10^{-4}$ inches (about 7.4 micrometers), and include but are not limited to E225, D450 and D900 yarns. For example, a non-limiting fabric style using E225 E-glass fiber yarns is Style 2116, which has 118 warp yarns and 114 fill (or weft) yarns per 5 centimeters (60 warp yarns and 58 fill yarns per inch); uses 7 22 1×0 (E225 1/0) warp and fill yarns; has a nominal fabric thickness of 0.094 millimeters (about 0.037 inches); and a fabric weight (or basis weight) of 103.8 grams per square meter (about 3.06 ounces per square yard). A non-limiting example of a fabric style using D450 E-glass fiber yarns is Style 1080, which has 118 warp yarns and 93 fill yarns per 5 centimeters (60 warp yarns and 47 fill yarns per inch); uses 5 11 1×0 (D450 1/0) warp and fill yarns; has a nominal fabric thickness of 0.053 millimeters (about 0.0021 inches); and a fabric weight of 46.8 grams per square meter (about 1.38 ounces per square yard). A non-limiting example of a fabric style using D900 E-glass fiber yarns is Style 106, which has 110 warp yarns and 110 fill yarns per 5 centimeters (56 warp yarns and 56 fill yarns per inch); uses 5 5.5 1×0 (D900 1/0) warp and fill yarns; has a nominal fabric thickness of 0.033 millimeters (about 0.013 inches); and a fabric weight of 24.4 grams per square meter (about 0.72 ounces per square yard). Another non-limiting example of a fabric style using D900 E-glass fiber yarns is Style 108, which has 118 warp yarns and 93 fill yarns per 5 centimeters (60 warp yarns and 47 fill yarns per inch); uses 5 5.5 1×2 (D900 1/2) warp and fill yarns; has a nominal fabric thickness of 0.061 millimeters (about 0.0024 inches); and a fabric weight of 47.5 grams per square meter (about 1.40 ounces 25 per square yard). A non-limiting example of a fabric style using both E225 and D450 E-glass fiber yarns is Style 2113, which has 118 warp yarns and 110 fill yarns per 5 centimeters (60 warp yarns and 56 fill yarns per inch); uses 7 22 1×0 (E225 1/0) warp yarn and 5 11 1×0 (D450 1/0) fill yarn; has a nominal fabric thickness of 0.079 millimeters (about 0.0031 inches); and a fabric weight of 78.0 grams per square meter (about 2.30 ounces per square yard).

These and other fabric style specification are given in IPC-EG-140 "Specification for Finished Fabric Woven from 'E' Glass for Printed Boards", a publication of The Institute for Interconnecting and Packaging Electronic Circuits (June 1997), which is specifically incorporated by reference herein. Although the aforementioned fabric styles use twisted yarns, it is contemplated that these or other fabric styles using zero-twist yarns or rovings in conjunction with or in lieu of twisted yarns can be made in accordance with the present invention.

It is noted that the above fabric types each include at least 56 warp yarns per inch while a fabric such as a 7628 style fabric which uses a coarser G75 yarn includes 44 yarns per inch. It is believed that the increased yarn density of fabrics incorporating the fine warp yarns contributes to the tendency of the fine yarn to become entangled on a standard whip roll. As a result, in one non-limiting embodiment of the present invention, the whip roll is used to weave fabrics incorporating warp yarn having a resin compatible coating and a warp yarn density of at least 50 warp yarns per inch, preferably at least 56 warp yarns per inch, and more preferably at least 60 warp yarns per inch.

It will be appreciated by those skilled in the art that changes could be made to the embodiments described above without departing from the broad inventive concept thereof. It is understood, therefore, that this invention is not limited to the particular embodiments disclosed, but is intended to cover modifications which are within the spirit and scope of the invention, as defined by the appended claims.

I claim:

1. A method of delivering warp yarn into an air jet loom, comprising the steps of:

providing a loom beam comprising warp yarn having a resin compatible coating;

drawing warp yarn from the loom beam;

contacting the warp yarn with a whip roll having a reduced surface area such that the warp yarn contacts at least a portion of the reduced surface area of the whip roll; and directing the warp yarn into an air jet loom.

2. The method according to claim 1, wherein at least a portion of the reduced surface area of the whip roll has a textured surface.

3. The method according to claim 1, wherein the providing step provides the warp yarn at a warp yarn density of at least 50 yarns per inch.

4. The method according to claim 3, wherein the providing step provides the warp yarn at a warp yarn density of at least 56 yarns per inch.

5. The method according to claim 4, wherein the providing step provides the warp yarn at a warp yarn density of at least b 60yarns per inch.

6. The method according to claim 1 wherein the providing step comprises providing a warp yarn that is a fine yarn.

7. The method according to claim 1, wherein the roll includes a plurality of grooves extending along at least a portion of the roll.

8. The method according to claim 1, further including the step of forming a warp shed from the warp yarn and inserting a fill yarn having a resin compatible coating into the warp shed.

9. The method according to claim 1, wherein the reduced surface area of the whip roll includes a plurality of grooves.

10. The method according to claim 9, wherein the grooves are equally spaced and generally parallel to each other.

11. The method according to claim 1, wherein the reduced surface area of the whip roll is no greater than 50% of its equivalent surface.

12. The method according to claim 11, wherein the reduced surface area of the whip roll is no greater than 25% of its equivalent surface.

13. The method according to claim 11, wherein the providing step provides the warp yarn at a warp yarn density of at least 50 yarns per inch.

14. The method according to claim 13, wherein the reduced surface area of the whip roll includes a plurality of grooves.

15. The method according to claim 14 wherein the providing step comprises providing a warp yarn that is a fine yarn.

16. The method according to claim 15, wherein at least a portion of the reduced surface area of the whip roll has a textured surface.

17. The method according to claim 1, further including the step of forming a warp shed from the warp yarn and inserting a fill yarn having a resin compatible coating into the warp shed.

18. A fabric made according to the method of claim 1.

19. A fabric made according to the method of claim 17.

* * * * *

UNITED STATES PATENT AND TRADEMARK OFFICE

CERTIFICATE OF CORRECTION

PATENT NO. : 6,283,164 B1
DATED : September 4, 2001
INVENTOR(S) : Steven J. Parks It is certified that error appears in the above-identified patent and that said Letters Patent is hereby corrected as shown below:

Column 8,
Line 3, delete “b” after “least”; insert a space after “60”.

Signed and Sealed this

Fourth Day of June, 2002

*Attest:*

*Attesting Officer*

JAMES E. ROGAN
*Director of the United States Patent and Trademark Office*